United States Patent [19]

Boecker et al.

[11] Patent Number: 4,677,915

[45] Date of Patent: Jul. 7, 1987

[54] ARMOR-PIERCING PROJECTILE

[75] Inventors: Juegen Boecker, Oberhausen; Klaus Gersbach, Willich; Karl W. Bethmann, Moers, all of Fed. Rep. of Germany

[73] Assignee: Rheinmetall GmbH, Duesseldorf, Fed. Rep. of Germany

[21] Appl. No.: 624,043

[22] Filed: Jun. 25, 1984

Related U.S. Application Data

[63] Continuation-in-part of Ser. No. 395,793, Jul. 6, 1982, abandoned.

[30] Foreign Application Priority Data

Jul. 4, 1981 [DE] Fed. Rep. of Germany ..... 3126399

[51] Int. Cl.[4] ..... F42B 11/00

[52] U.S. Cl. ..... 102/517; 102/511

[58] Field of Search ..... 102/501, 502, 506, 517–523, 102/511, 273, 398

[56] References Cited

U.S. PATENT DOCUMENTS

| | | | |
|---|---|---|---|
| 465,230 | 12/1891 | Wilson, Jr. | 102/519 |
| 1,089,161 | 3/1914 | Shore | 102/518 |
| 1,481,930 | 1/1924 | Schneider | 102/511 |
| 3,370,535 | 2/1968 | Permutter | 102/518 |
| 3,620,167 | 11/1971 | Romer et al. . | |
| 4,075,946 | 2/1978 | Deffayet et al. . | |
| 4,108,072 | 8/1978 | Trinko et al. . | |
| 4,353,305 | 10/1982 | Moreau et al. | 102/519 |
| 4,362,107 | 12/1982 | Romer et al. | 102/517 |

FOREIGN PATENT DOCUMENTS

| | | | |
|---|---|---|---|
| 166228 | 2/1959 | Sweden | 102/518 |
| 1002869 | 9/1965 | United Kingdom | 102/517 |

*Primary Examiner*—Harold J. Tudor

[57] ABSTRACT

A sub-caliber armor-piercing projectile exhibits for improving its penetration effect against a strongly inclined target surface a break-up in the region of a fracture zone of an expendable nose portion. The latter is provided at its point region with an arrangement which favors a sliding-off, which arrangement includes at least two frusto-conical surfaces which encompass the longitudinal projectile axis A and which surfaces are differently inclined with respect to the longitudinal axis of the projectile or include a sphere disposed in a spherical recess. The arrangement can be cladded with a ballistic hood and can be provided in the region of the frusto-conical or the spherical surfaces with a lubricating medium. The fracture zone is constructed in such a way that when a deviating sliding-off of the arrangement occurs, as large as possible a twisting impulse is transferred under the main projectile portion in order to improve its penetration capability by means of a more favorable penetrating angle.

8 Claims, 5 Drawing Figures

FIG. 1
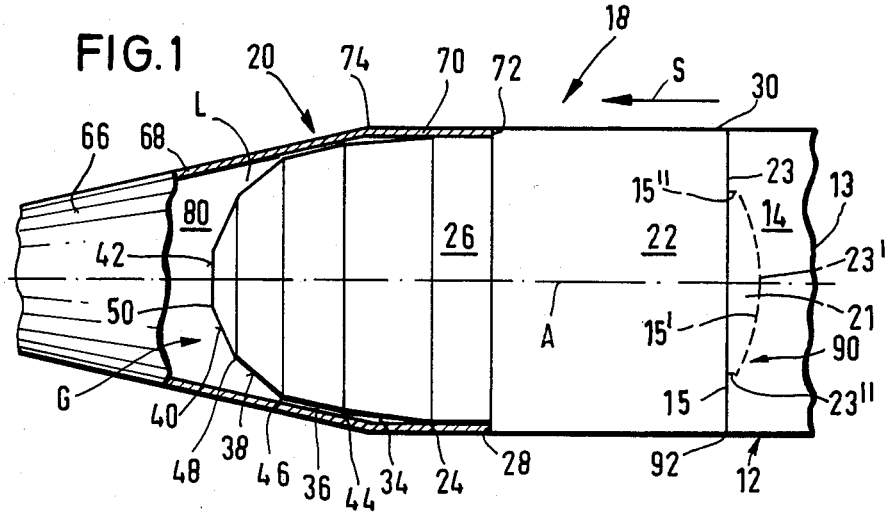
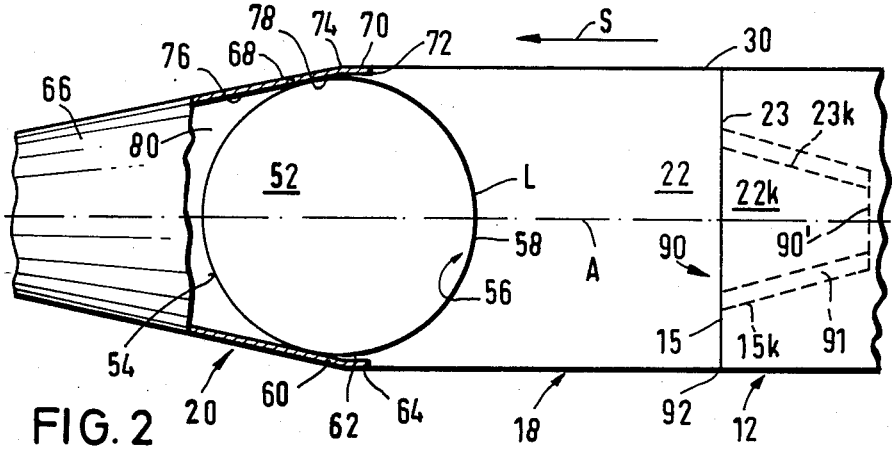
FIG. 2
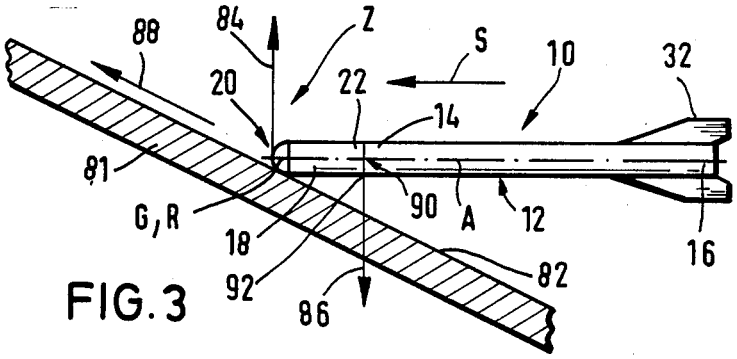
FIG. 3

ARMOR-PIERCING PROJECTILE

CROSS-REFERENCE TO RELATED APPLICATION

This is a continuation-in-part application of our copending application Ser. No. 395,793, filed on July 6, 1982 abandoned.

BACKGROUND OF THE INVENTION

The invention relates to an armor-piercing projectile which includes in its body a soft cast brass ring. Armor-piercing projectiles of this type are already known and described in British Pat. No. 941,524. Such known projectile has a rear main projectile portion which consists of hard metal and which includes in its ogival nose region a layer of soft cast brass material. The cast brass layer has in its front side a ring-shaped body made out of hard metal, the forward edge of which coincides with the periphery of the projectile and borders on a flat end face of the projectile. This end face is preferably covered by means of a ballistic cap. At a very flat impacting of the projectile on an armored target surface, the forward edge of the ring-shaped hard metallic body is to penetrate into the armored target surface without the point of the main projectile portion being damaged. Due to the frictional contact between the ring-shaped hard metallic body and the target surface, the projectile is turned about a greater angle of impact so that penetration of the target is better. Despite the fact that the cast brass layer is disposed between the nose of the main projectile portion and the ring-shaped hard-metal body, the impact shock can prematurely lead to a destruction of the main projectile portion. A further danger of break up for the main projectile portion results from the transfer of the twisting moment, so that with a multi-plated target the effect of the main projectile portion is already spent at the outer plate. The front edge of the ring-shaped hard metallic body must in addition thereto be arranged from the longitudinal axis of the projectile at a sufficient radial distance which can disadvantageously lead to a large projectile diameter.

SUMMARY OF THE INVENTION

It is an object of this invention to provide an armor-piercing projectile of the afore-described type which upon flat impacting on a target surface, even against multi-layered targets of different construction, is sufficiently effective. The projectie of the invention does not include the soft cast brass ring which has been described with respect to the state of the art armor-piercing projectiles of British Pat. No. 941,524, but does nevertheless achieve a more favorable penetration angle against multi-plated armored targets upon flat impacting thereagainst.

DESCRIPTION OF THE DRAWING

With these and other objects in view, which will become apparent in the following detailed description, the present invention, which is shown by example only, will be clearly understood in connection with the accompanying drawing, in which:

FIG. 2 illustrates a second embodiment of a projectile of this invention which also shows the front region of the projectile partially in cross-section and side elevation;

FIG. 3 is a schematic view of the projectile of this invention flatly impacting on a target surface which illustrates the effectiveness of the projectile illustrated in FIGS. 1 and 2.

DETAILED DESCRIPTION

Figure 1A:
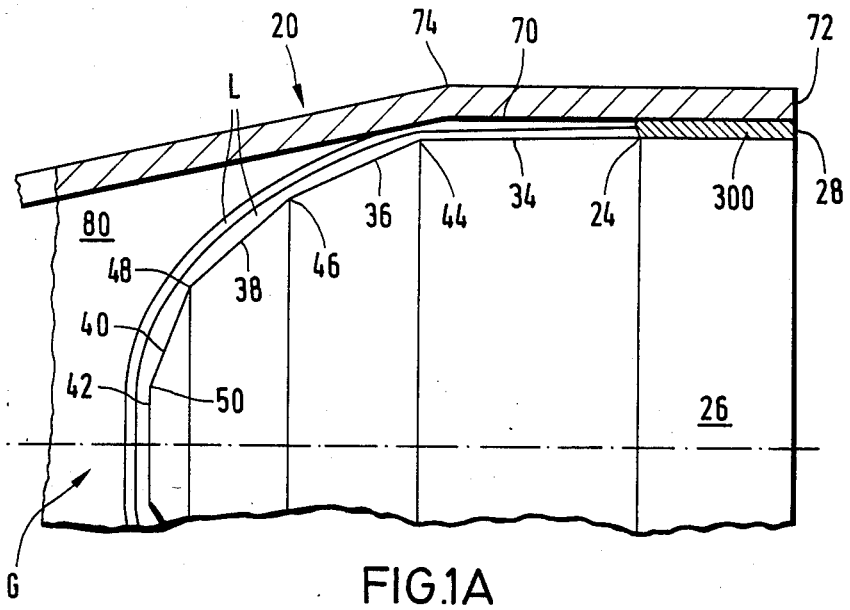
FIGS. 1A and 1B are cross-sectional views of constructional details in the respective embodiments of FIGS. 1 and 2.
Figure 1B:
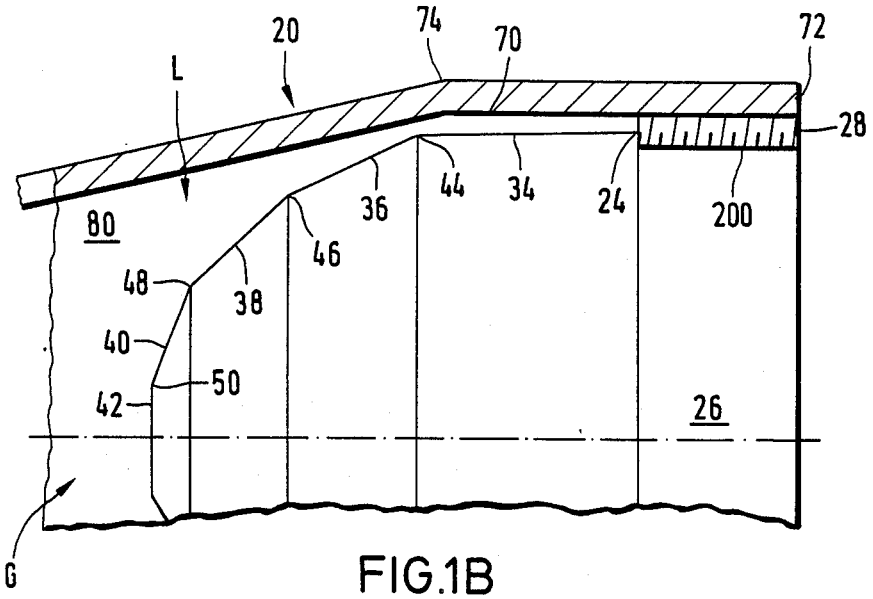
Figure 1C:
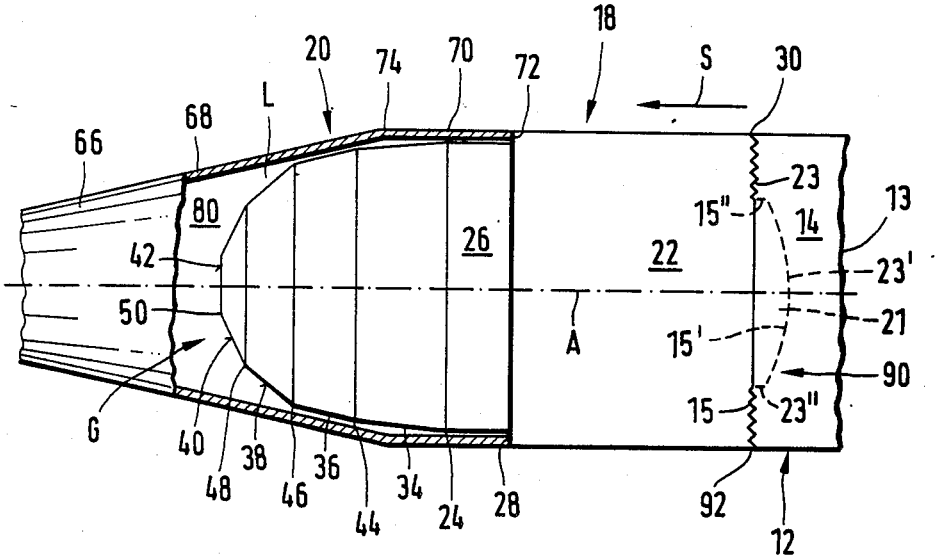
FIG. 1 illustrates a first embodiment of the front region of a projectile which is shown partially in cross-section shown and in side elevation.

The projectile of FIG. 1 includes a main projectile portion 12 of a sub-caliber projectile 10 having a front region 14 to which there is adjoined a nose portion 18 having a point region 20 and a rear region 22. The front point region 20 is provided with a ballistic hood 66, whereas in the border region between the nose portion 18 and the front region 14 there is disposed a fracture zone 90 disposed between two curved surfaces 15' and 23' which is to be described in detail hereinafter. The hollow space 100 together with the confronting curved surfaces 15', 23' forms a fracture zone (FIG. 1). This hollow space 90 also serves to permit a correct interfitting of nose portion 18 and projectile portion 12 thereby lowering the manufacturing tolerances for the projectile. In the embodiment of FIG. 2 a frusto-conical projection 22K and frusto-conical recess 15K define a hollow space 90', 91 therebetween which has an analogous function as the hollow space 100 in the embodiment of FIG. 1. The point region 20 is rearwardly defined by means of a peripheral edge 24 from which there extends forwardly a frusto-conical surface 34 which is inclined towards the longitudinal projectile axis A in the firing direction S and which is delimitated forwardly by the edge 44. This edge 44 defines the rearward limit of a second frusto-conical surface 36 which is more strongly inclined towards the projectile longitudinal axis A in the firing direction S, which surface also encompasses and is coaxial with respect to the longitudinal projectile axis A, as is and does the surface 34. The frusto-conical surface 36 is defined at its front by an edge 46. A third frusto-conical surface 36 adjoins the edge 46 which third surface is even more strongly inclined with respect to the projectile axis A in the firing direction S and which third frusto-conical surface 36 is disposed between the front edge 48 and the rear edge 46. The front edge 48 constitutes the rear limit of a further, more strongly inclined frusto-conical surface 40, that is a surface which is more inclined than the surface 38 towards the projectile longitudinal axis A in the firing direction S, the front edge 50 of which is delimited by a circular encompassing circle which is coaxial with respect to the longitudinal projectile axis A. This edge 50 defines a flat front surface 42 which is normal to the longitudinal projectile axis A. Between the front edge 24 and the rearwardly disposed circular edge 28 there extends a cylindrical portion 26. The ballistic hood 66 is formed by a cladding 68 which covers the point region 20 of the nose portion 18, whereby the skirt 70 of the hood 66 extends from the exterior edge 74 up to the rear circular ring surface 72, which skirt 70 has an internal diameter that conforms to the exterior diameter of the cylindrical portion 26. The ballistic hood 66 is arranged in such a way, that both circular ring surfaces 28 and 72 are closely adjacent to each other and can, for example, be firmly joined to each other by soldering to form a joint 300 (FIG. 1A) or any other suitable joining process. A cylindrical peripheral surface 30 extends forwardly up to the outer edge 74. The cylindrical portion 26 can, however, also be provided with an external illustrated thread (FIG. 1B) which mates with an also non-illustrated inner thread in the skirt 70. The surfaces 34, 36, 38 and 40 in the point region 20 of the nose portion 18 form an arrangement referred to generally with the reference letter G. This arrangement has the object, when a flat impacting of the projectile occurs against a target surface 82 (see FIG. 3), to cause the thereby involved surfaces 34, 36, 38 or 40 to favor a mutual slidable displacement of adjoining surfaces with reduced friction. In order to additionally reduce the frictional contact between the target surface 82 and the corresponding surfaces 34, 36, 38 or 40, the latter can be provided with a lubricating medium L. For example the following materials have been found as suitable: Graphite, molybdenum disulphide, glass and lead as well as other low-temperature melting metals. It is of course also possible to use a plurality of lubricating means L (FIG. A), whereby the surfaces 34, 36, 38 and 40 include a corresponding layer of lubricating medium and/or the inner space 80 of the ballistic hood 66 is filled with a lubricating medium (FIG. 1B). In the latter case there can, for example, be used glass as well as lead or another metal in pulverous form and the described arrangement can be provided with a threaded portion in the skirt 70 and the mating threaded portion in the cylindrical portion 26. Such an arrangement has been found to be particularly advantageous.

In the embodiment of FIG. 2 the nose portion 18 is provided in its point region 20 with a rotatably mounted sphere 52, which is generally designated with the reference letter R and has been designed to reduce the friction between the nose portion and the target surface. The nose portion 18 is provided with a hemispherical indentation 56 defined by a hollow spherical surface 58 which serves to receive the sphere 52. The hollow spherical surface 58 is defined forwardly by means of an annular ring surface 60 up to which a rearwardly facing annular surface 64 of a cylindrical portion 62 extends. In this second embodiment of an armor-piercing projectile the ballistic hood 66 has in its inner space 80 an enclosing inner surface 76 of the cladding 68 which includes a contacting region 78 which contacts the spherical surface 54. The joining of the ballistic hood 66 with the nose portion 18 is analogous to that described in the first embodiment of FIG. 1. The friction-reducing lubricating medium L is advantageously arranged in a not further illustrated and described region disposed between the hollow spherical surface 58 of the hemi-spherical indentation 56 and the surface of the sphere 54.

MANNER OF OPERATION

The manner of operation of the armor-piercing projectile of this invention is described in conjunction with FIG. 3. The armor-piercing projectile 10 (the ballistic hood is not illustrated for sake of clarity) approaches along a nonillustrated flight path an armored target 81 which is illustrated in section and contacts it with the arrangement G (respectively R) at the target surface 82 in an impact region Z. The projection of the target surface 82 in the plane of the drawing makes an acute angle with the longitudinal projectile axis A which angle has not been illustrated in detail. Thanks to the friction-reducing gliding-off effect of the arrangement G (respectively R) the point region 20 of the nose portion 18 is deflected from the target surface 82 in the direction of an arrow 84 facing away from said target surface 82. Thereby the rear region 22 of the nose portion 18 is swung in the direction of the arrow 86 which faces in the opposite direction than the arrow 84 against the target surface 82. At the impacting and sliding-off deflection there are suddenly and shockwise introduced considerable forces transversely to the longitudinal axis of the projectile in the armor-piercing projectile 10. This causes the fracture zone 90 to be effective. The latter is formed in such a way that still a considerable portion of the rotating impulses in a direction of the arrow 86 become effective via the front region 14 onto the main projectile portion 12, so that the latter rotates relative to the target surface 82 and the projectile axis A makes only an angle with the projection on the target surface 82 which is larger than that angle that is formed at the instant of contact of the arrangement G(respectively R) with the target surface 82. As a result there is achieved advantageously for the main projectile portion 12 comparatively substantially better penetration capability. In particular, there is advantageously avoided that the projectile main portion 12, as a result of a hard impact shock, breaks up and thereby inhibits considerably a target effectiveness. Since moreover the used up nose portion 18 distances itself in the direction of the arrow 88 from the impact region Z, this cannot disturb the penetration process of the main projectile portion 12. A stabilizing guide arrangement 32 is provided in the tail section 16 of the main projectile portion 12 (which is described in the co-assigned West-German published application Ser. No. 303808.1, filed Oct. 9, 1980) which can advantageously separate from the main projectile portion 12, for purposes of not inhibiting the penetration capability of the main projectile portion 12.

The fracture zone 90 should be particularly carefully constructed. In both of the illustrated embodiments a front flat end surface 15 of the front region 14 of the main projectile portion 12 and also a flat rearwardly facing surface 23 of the rear region 22 of the nose portion 18 form a butt joint which includes the fracture zone 90. A joint between both surfaces 15 and 23 is formed in such a way that during the course of the breaking up process as large as possible a portion of the twisting moment becomes effective on the main projectile portion 12. For this purpose it can be advantageous to enlarge both surfaces 15 and 23 by making the surface 15 concave and the surface 23 convex. In any case, a border region which encompasses and borders on the surface 15 has advantageously a sharp, tough-hardened cutting edge 92 for achieving an increase target effectiveness.

For purposes of not only substantially constructionally defining the front region 14 in the vicinity of the edge 92, the fracture zone 90 is constructed by means of a predetermined structural weakening. It has been found, for example, that material-irradiation, for example neutron irradiation, has been particularly effective. The fracture zone 90 can also be formed by means of slits in such a way that the nose portion 18 is joined in a predetermined manner with the front region 14 of the main projectile portion 12, respectively via the flat surfaces 15 and 23. This joint is designed so that it is insured that when a peripheral break-up occurs, the region proximate to the target surface 82 forms a rapidly decreasing joint cross-section occurs between nose portion 18 and front region 14 so that an impulse which deviates against the target surface 82 becomes sufficiently effective against the front region 14 of the main projectile portion 12 so that: between the longitudinal axis of the latter and the target surface 82 there is attained such an angle that favors the penetration process. A fracture zone 90 which complies with the aforedescribed condition is for example constructed as is illustrated in dashed lines in FIG. 1. The surface 23 has a convex region 23' with which it is connected by means of an annular ring surface 23''. A countersurface defining concave recesses 15' and 15'', annular ring surface, correspondingly shaped, confront the surfaces 23' and 23'' and define jointly with surfaces 15', 15'' a gap 100. Advantageously there is thereby achieved first of all that the force-transfer surfaces are enlarged, which favors a mutual joining and thereby impulse transfer. Furthermore there results due to the "mortise joint" formed by the surfaces 15'' and 23'', a good force transfer. Finally, there is illustrated in FIG. 2 with dashed lines an alternate embodiment for a fracture zone 90. The fracture zone 90 includes a conically shaped recess **15*k* in the front region 14, which merges with the surface 15 to form an annular surface; a frusto-conically shaped projection 22*k* corresponding in shape to the recess 15*k* projects from the also annular surface 23. The respective 400, 500 end faces of the confronting frusto-cones 22K and 15K define a gap 90' therebetween which functions in a manner analogous to the gap 100 in the embodiment of FIG. 1. While the mutually adjacent and not further designated surfaces form a butt joint (which is also illustrated) there remains between the recess 15*k* and the frusto-conical cladding 23*k* an intermediate space 91. The butt joints of the embodiments of FIGS. 1 and 2 are advantageously, by means of corresponding slits or mortise joints, pulled into the fracture zone 90**.

A breaking-up process, upon impacting, is introduced into the edge region between the annular surfaces 15 and 23. As the projectile progresses, the joint in the butt joint also collapses. In view of the play that exists due to the presence of the intermediate space 91, 100 the surface **23*k*, 15' can transmit a useful impulse to the surface 15*k*, 23' prior to the nose portion 18 distancing itself in the direction of the arrow 88 (see FIG. 3) from the impact region Z without disturbing the following penetration process by the main projectile portion 12 into the armor plate 81**.

The main portion of the subcaliber projectile of this invention has a length to diameter ratio ranging from 10/1 to 30/1.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

We claim:

1. An improved armor-piercing sub-caliber projectile which is provided with an expendable ballistic hood covering a nose portion for transferring upon target impact a twisting moment onto a rearwardly disposed main portion of the sub-caliber projectile so that upon a flat target impact a steeper penetration angle of the main portion of the sub-caliber projectile is achieved, which improvement comprises:

(a) said nose portion has a rear surface and said main portion has a front surface, both of said surfaces being arranged transverse to the longitudinal axis of the projectile both said surfaces being at least partially flat and being abuttingly joined to each other so that said main portion is joined to said nose portion;

(b) said rear and front surfaces confronting each other and jointly defining a fracture zone of said projectile;

(c) said rear surface of said nose portion including a rearwardly projecting surface which engages into a rearwardly recessed surface of said front surface of said main portion;

(d) the projectile has a length to diameter ratio ranging from 10/1 to 30/1; and (e) said nose portion is provided with means for reducing the friction between said nose portion and a target surface upon flat impact.

2. The improvement in an armor-piercing sub-caliber projectile as set forth in claim 1, wherein the front region of the main projectile portion includes an outer peripheral cutting edge adjoining said fracture zone.

3. The improvement in an armor-piercing sub-caliber projectile as set forth in claim 2, wherein said means for reducing said frictional contact includes at least two matingly and mutually confronting frusto-conical surfaces which are coaxially arranged relative to the longitudinal axis of the projectile one of said two surfaces forms part of said nose portion and the other one forms part of said main portion, said mutually confronting surfaces defining a predetermined gap therebetween.

4. The improvement in an armor-piercing sub-caliber projectile as set forth in claim 2, including lubricating means forming part of said means for reducing said frictional contact.

5. The improvement in an armor-piercing sub-caliber projectile as set forth in claim 2, wherein said lubricating means are disposed and fill said balistic hood.

6. The improvement in an armor-piercing sub-caliber projectile as set forth in claim 1, wherein said fracture zone is formed by means of precut surfaces in said rear end of said nose portion.

7. The improvement in an armor-piercing sub-caliber projectile as set forth in claim 1, wherein the nose portion and main portion of the projectile have mutually confronting and mating convex-concave surfaces which form at least partially said fracture zone.

8. The improvement in an armor-piercing sub-caliber projectile as set forth in claim 5, (a) wherein the nose portion and main portion of the projectile have mutually confronting and mating frusto-conical projection and recess which are respectively surrounded by mutually confronting annular surfaces;

(b) said frusto-conical projection and recess are spaced from each other at a predetermined distance so as to form a predetermined hollow space; and (c) said fracture zone encompassing said hollow space.

* * * * *